US005829628A

United States Patent [19]

Lount

[11] Patent Number: 5,829,628

[45] Date of Patent: Nov. 3, 1998

[54] WASTE CONTAINER ADAPTED FOR CUTTING TOE NAILS

[76] Inventor: Derek Ure Lount, 6-12 McGillivray Place, Winnipeg, Manitoba, Canada, R3T 1N4

[21] Appl. No.: 825,901

[22] Filed: Apr. 2, 1997

[51] Int. Cl.[6] ..... B65D 25/00

[52] U.S. Cl. ..... 220/695; 220/660; 220/908

[58] Field of Search ..... 220/760, 657, 220/659, 910, 574.1, 576, 729, 660, 695, 908

[56] References Cited

U.S. PATENT DOCUMENTS

| | | | |
|---|---|---|---|
| 229,158 | 6/1880 | Mander | 220/657 |
| 1,811,896 | 6/1931 | Ross | 220/657 X |
| 1,959,262 | 5/1934 | Colabrese | 220/632 |
| 2,797,136 | 6/1957 | Nelson | 220/908 X |
| 2,988,767 | 6/1961 | Tretwold et al. | 220/695 X |
| 4,679,700 | 7/1987 | Tharrington et al. | 220/908 X |
| 4,878,590 | 11/1989 | Porter | 220/908 X |
| 5,158,193 | 10/1992 | Chen | 220/729 X |

*Primary Examiner*—Steven M. Pollard
*Attorney, Agent, or Firm*—Adrian D. Battison; Murray E. Thrift

[57] ABSTRACT

A waste container for use in cutting toe nails has a shelf arranged at least partly over the open top for resting the foot with the toes of the foot projecting over the open top of the container so that cut toe nails fall into the open top. The shelf is inclined to the horizontal such as a front edge thereof is lower than a rear edge thereof and is defined by a top portion of one side wall which is bent inwardly to lie over the open top.

3 Claims, 4 Drawing Sheets

WASTE CONTAINER ADAPTED FOR CUTTING TOE NAILS

BACKGROUND OF THE INVENTION

This invention relates to a waste container which is particularly adapted for use as a foot care rest which allows the user to carry out toe nail cutting and other foot care procedures while having the container readily available for toe nails and other waste materials. SUMMARY OF THE INVENTION According to one aspect of the invention there is provided a waste container comprising:

a base wall for resting on a horizontal support surface;

two upstanding side walls, a front wall for facing forwardly toward a user and a rear wall opposite to the front wall and spaced rearwardly therefrom;

the front wall, side walls and rear wall defining an open top for deposit of materials into the container for storage therein;

the front wall including a substantially upright transverse portion and two side portions each on a respective side of the transverse portion and extending therefrom to connect to a respective one of the side walls;

each of the side portions being inclined inwardly and rearwardly from a front edge of the respective side wall such that the transverse portion of the front wall is recessed rearwardly from the front edges of the side walls;

and a shelf member connected to a top edge of the transverse portion of the front wall and extending therefrom forwardly and downwardly so as to provide a shelf surface for receiving a foot of a user thereon with toes of the foot projecting from the top edge of the transverse portion over the open top for toe nails cut from the toes to fall into the open top.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

The container comprises a horizontal flat base wall 10 with a layer of a slip resistant material on the bottom surface of the base wall 10. In the example shown the layer comprises a plurality of studs 11 formed of rubber or similar resilient material placed on the bottom surface for locating the bottom surface and preventing sliding relative to a floor when pressure is applied to the container.

Figure 1:
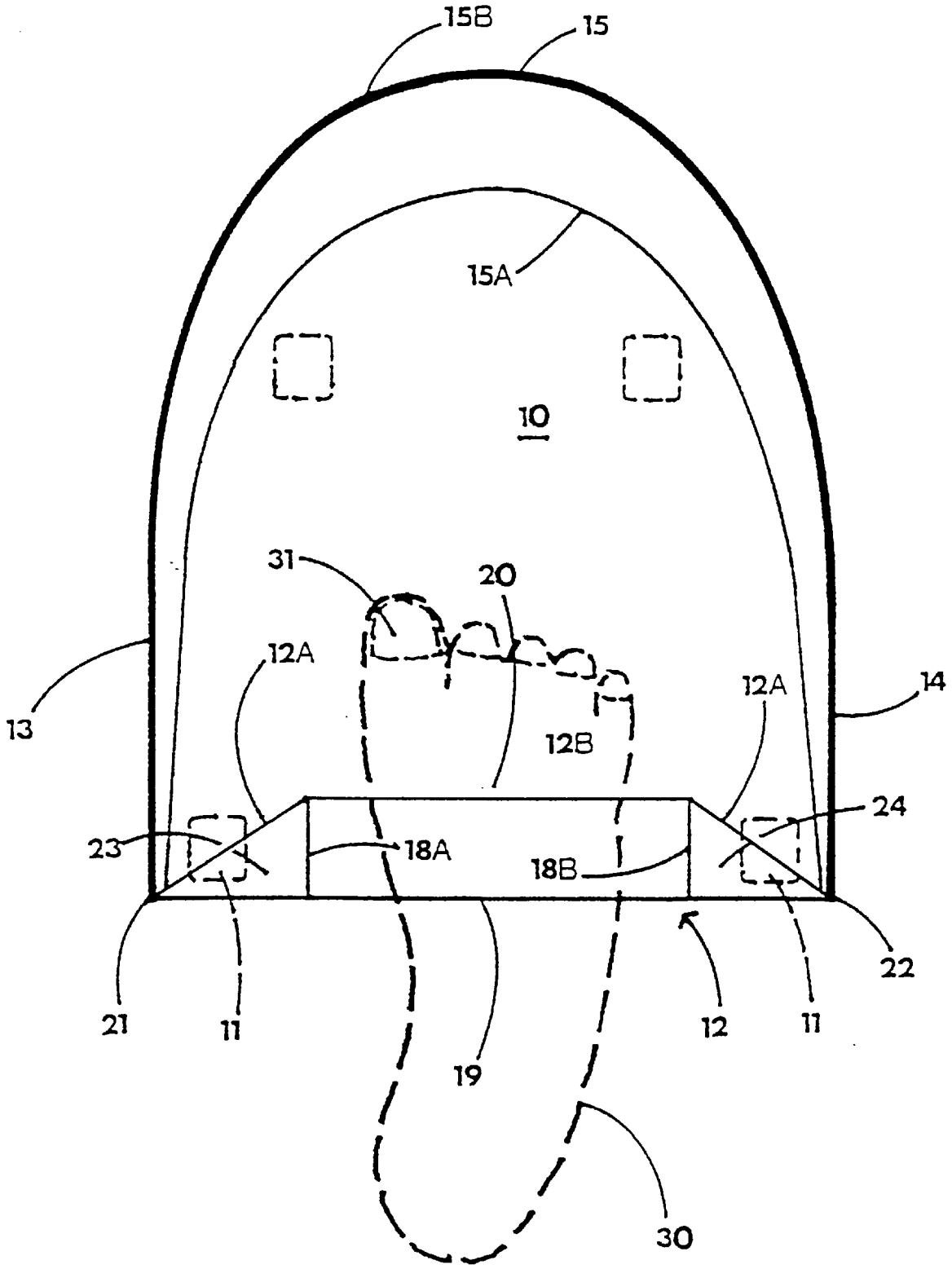
FIG. 1 is a top plan view of the waste container according to the present invention.
Figure 2:
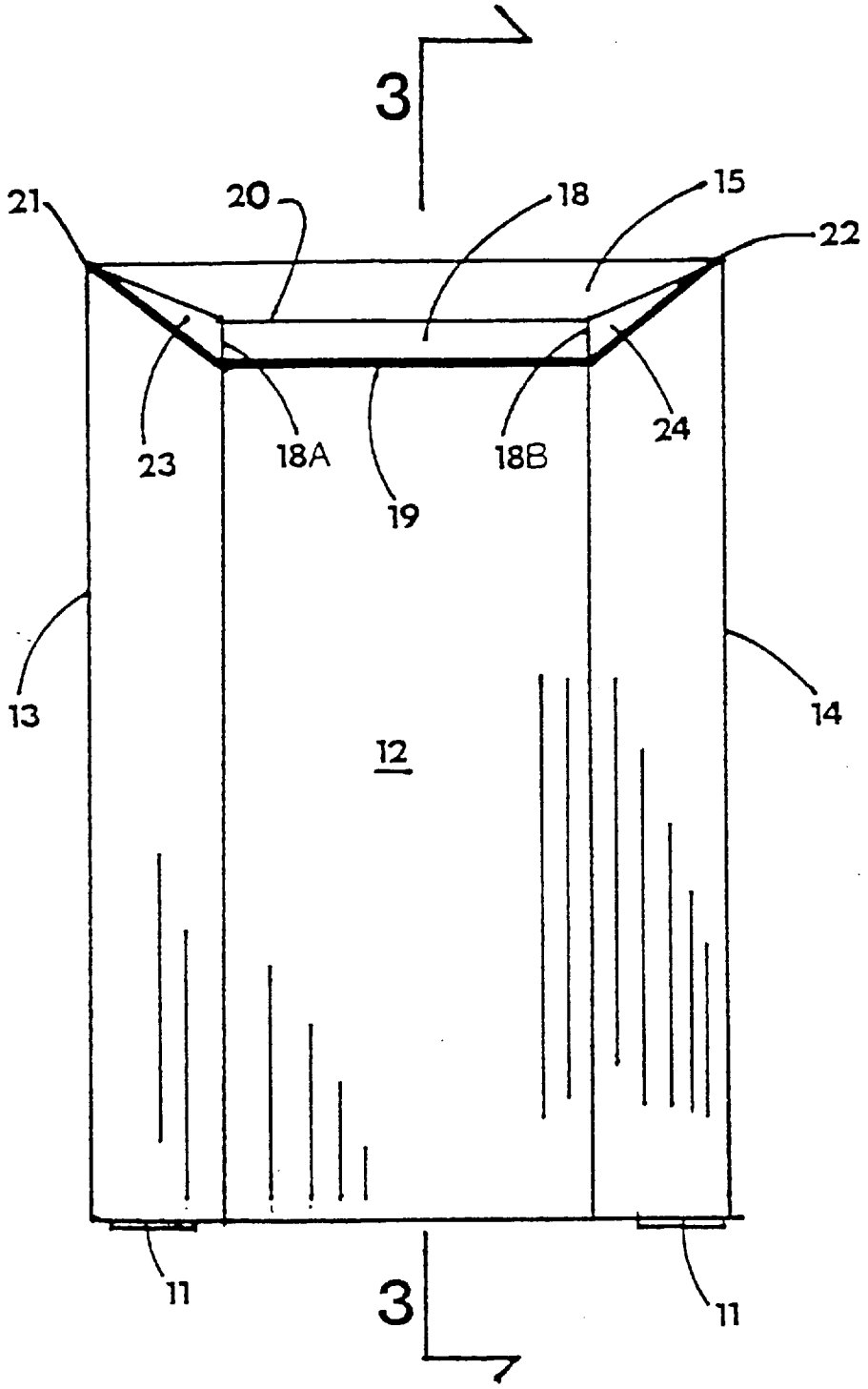
FIG. 2 is a front elevational view of the container of FIG. 1.
Figure 3:
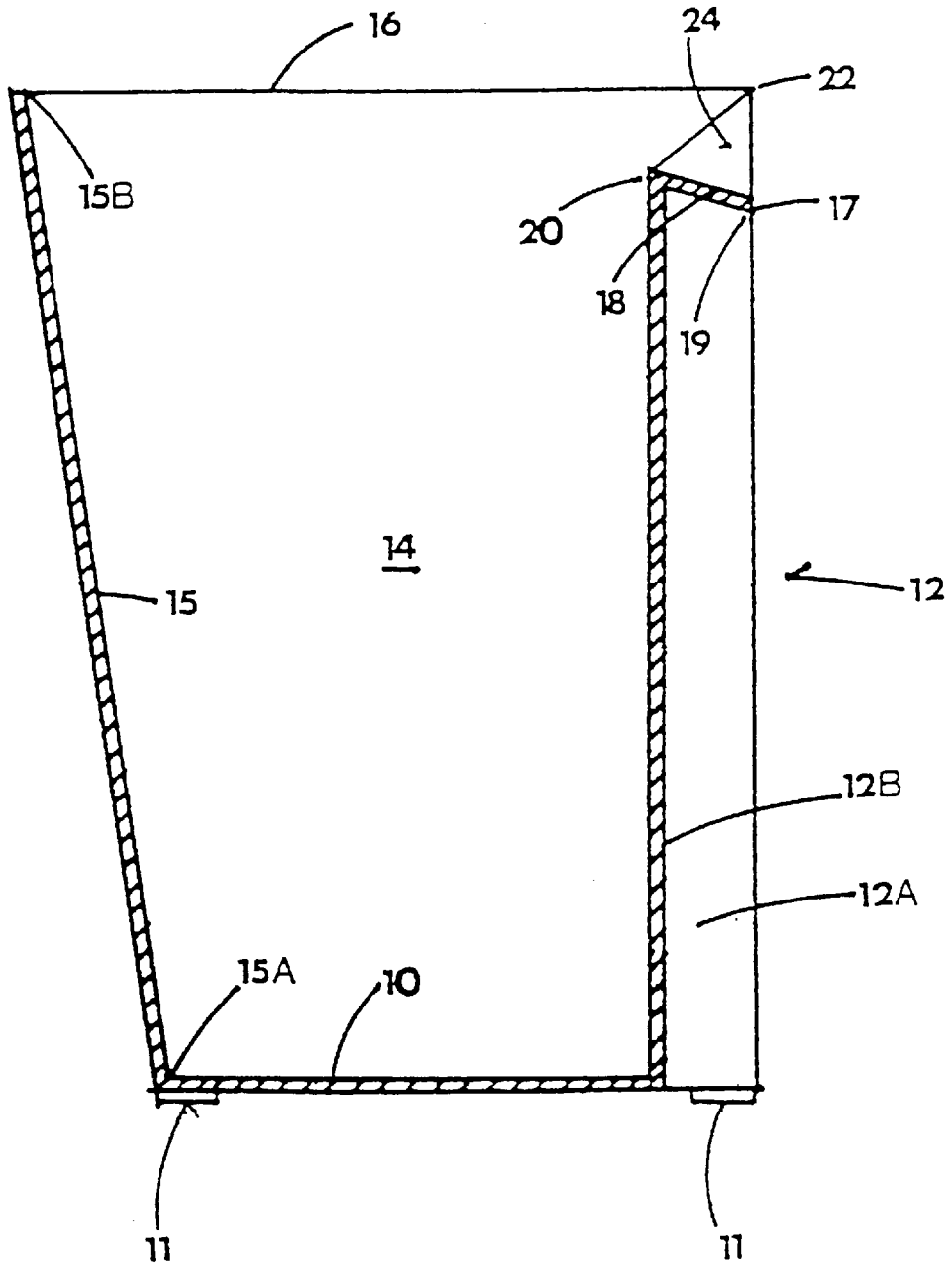
FIG. 3 is a cross sectional view along the lines 3—3 of FIG. 2.
Figure 4:
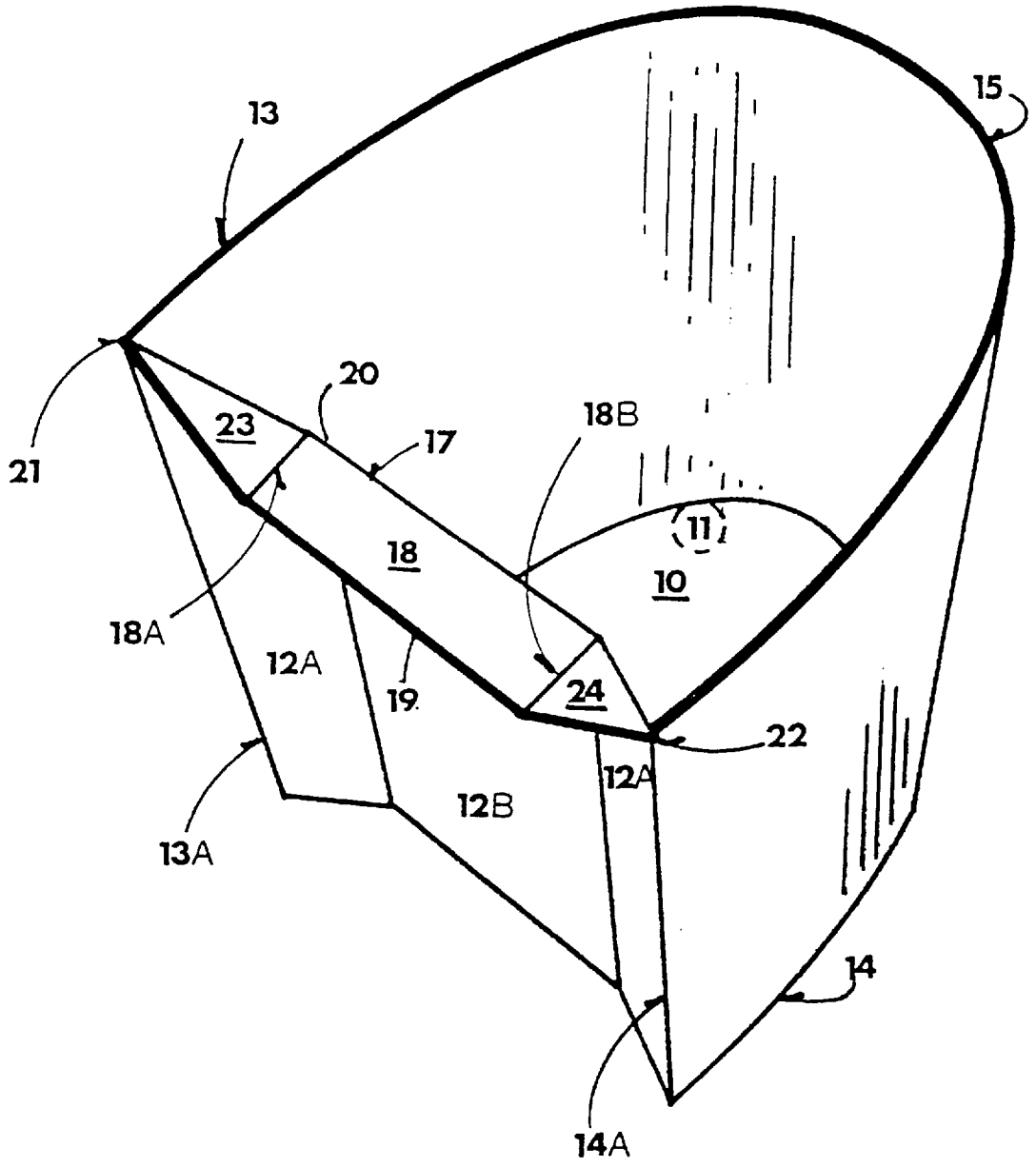
FIG. 4 is an isometric view of the waste container of FIG. 1.

The container comprises an upstanding front wall 12, two side walls 13 and 14 and a rear wall 15. The side walls 13 and 14 are substantially vertically upstanding and at right angles to the front wall 12. The rear wall 15 is substantially semi-circular in horizontal cross section and is inclined upwardly and rearwardly from a lower edge 15A at the base 11 to an upper edge 15B. As shown in the plan view of FIG. 1 each of the side walls 13 and 14 is also slightly tapered so that the edge of those walls joining the base 10 forms an arc spaced slightly inwardly from the arc defined by the top edge of those walls.

The walls thus define an open mouth 16 into which waste material can be deposited.

The front wall 12 is recessed from the front edges 13A, 14A of the side walls 13, 14 so that the front wall is inclined inwardly and rearwardly at two side portions 12A and then includes an upright transverse portion 12B approximately at right angles to the side walls. A top edge of the front wall is bent at junction 17 to define a shelf member 18 which is inclined downwardly and outwardly. The shelf member 18 thus has a rear edge 20 at the bend 17 and extends downwardly and outwardly from that rear edge to a front edge 19. The shelf member 18 is defined between two side edges 18A and 18B . At those side edges the material forming the shelf member is inclined upwardly to an apex 21, 22 joining with the side wall 13, 14 at the top of the side wall. Thus the shelf is lower than the top of the side walls. This forms therefore two triangular portion 23, 24. The shelf member thus is arranged to extend outwardly forwardly from the open top with a rear edge arranged at the open top for receiving the foot 30 of a user for cutting the toe nails 31 of the user. The foot can thus rest on the shelf member which provides a sufficiently wide pad to comfortably rest the ball of the foot while the toes project rearwardly over the open top. The foot is thus supported at a suitable location so that the user can reach to the toes and other areas of the foot for foot care procedures including toe nail cutting.

The recessed front wall and the projection of the shelf away from the open top allows the containers to stack each on the next.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A waste container comprising:

a base wall for resting on a horizontal support surface;

two upstanding side walls, a front wall for facing forwardly toward a user and a rear wall opposite to the front wall and spaced rearwardly therefrom;

the front wall, side walls and rear wall defining an open top for deposit of materials into the container for storage therein;

the front wall including a substantially upright transverse portion and two side portions each on a respective side of the transverse portion and extending therefrom to connect to a respective one of the side walls;

each of the side portions being inclined inwardly and rearwardly from a front edge of the respective side wall such that the transverse portion of the front wall is recessed rearwardly from the front edges of the side walls;

and a shelf member connected to a top edge of the transverse portion of the front wall and extending therefrom forwardly and downwardly so as to provide a shelf surface for receiving a foot of a user thereon with toes of the foot projecting from the top edge of the transverse portion over the open top for toe nails cut from the toes to fall into the open top.

2. A waste container comprising:

a base wall for resting on a horizontal support surface;

two upstanding side walls, a front wall for facing forwardly toward a user and a rear wall opposite to the front wall and spaced rearwardly therefrom;

the front wall, side walls and rear wall defining an open top for deposit of materials into the container for storage therein;

the front wall including a substantially upright transverse portion and two side portions each on a respective side of the transverse portion and extending therefrom to connect to a respective one of the side walls;

each of the side portions being inclined inwardly and rearwardly from a front edge of the respective side wall such that the transverse portion of the front wall is recessed rearwardly from the front edges of the side walls;

and a shelf member connected to a top edge of the transverse portion of the front wall and extending therefrom forwardly and downwardly so as to provide a shelf surface for receiving a foot of a user thereon with toes of the foot projecting from the top edge of the transverse portion over the open top for toe nails cut from the toes to fall into the open top.

the top edge of the transverse portion being arranged at a height below that of the top edges of the side walls such that the shelf member also is below the top edges of the side walls.

3. The container according to claim 2 wherein each side edge of the shelf member is connected by a respective one of two triangular portions to the respective side wall and wherein each triangular portion is inclined upwardly to an apex at the top edge of the respective side wall.

* * * * *